US011478093B2

(12) United States Patent
Romo et al.

(10) Patent No.: US 11,478,093 B2
(45) Date of Patent: Oct. 25, 2022

(54) TRAVEL PILLOW APPARATUS, STORAGE APPARATUS FOR THE TRAVEL PILLOW APPARATUS, AND METHODS OF MANUFACTURING AND USING THE SAME

(71) Applicant: D Squared Ventures, Aliso Viejo, CA (US)

(72) Inventors: Harry Duane Romo, Aliso Viejo, CA (US); David Hagopian, Irvine, CA (US)

(73) Assignee: D SQUARED VENTURES, Aliso Viejo, CA (US)

( * ) Notice: Subject to any disclaimer, the term of this patent is extended or adjusted under 35 U.S.C. 154(b) by 95 days.

(21) Appl. No.: 16/945,783

(22) Filed: Jul. 31, 2020

(65) Prior Publication Data

US 2021/0030174 A1 Feb. 4, 2021

Related U.S. Application Data

(60) Provisional application No. 62/882,487, filed on Aug. 3, 2019.

(51) Int. Cl.
*A47G 9/10* (2006.01)
*A47C 16/00* (2006.01)

(52) U.S. Cl.
CPC ..... *A47G 9/1027* (2013.01); *A47C 16/00* (2013.01); *A47G 9/1009* (2013.01); *A47G 9/1081* (2013.01); *A47G 2009/1018* (2013.01)

(58) Field of Classification Search
CPC ..... A47C 16/00; A47C 7/383; A47G 9/1027; A47G 9/1081; A47G 2009/1018; A47G 9/1045; A47G 9/10; A47G 9/1009; B65D 33/01; B65D 5/061; B65D 63/02; B65D 81/2007; B65D 81/2015; A61F 5/055; A61F 5/05816; A61F 5/012
See application file for complete search history.

(56) References Cited

U.S. PATENT DOCUMENTS 1,026,172 A 5/1912 O'Brien
1,487,923 A 3/1924 De Vilbiss
(Continued)

FOREIGN PATENT DOCUMENTS

EP 0280509 8/1988
JP 3084442 * 3/2020 ..... B42D 25/328
(Continued)

*Primary Examiner* — Eric J Kurilla
*Assistant Examiner* — Amanda L Bailey
(74) *Attorney, Agent, or Firm* — Garson & Gutierrez, PC

(57) ABSTRACT

Travel pillow apparatus, storage apparatus for the travel pillow apparatus, and methods of manufacture and use. In one embodiment, the travel pillow apparatus, includes an external covering, the external covering including upper and lower support structures; an air bladder apparatus that includes an expandable open-cell foam within an interior of the air bladder apparatus. The air bladder apparatus is further shorter in length than the external covering, such that the air bladder apparatus is not intended to be positioned towards the back of a neck of a user that is utilizing the travel pillow apparatus. A storage apparatus with a one-way expulsion valve for storage of, for example, the aforementioned travel pillow apparatus. Methods of manufacturing and using the aforementioned apparatus are also disclosed.

18 Claims, 7 Drawing Sheets

(56) References Cited

U.S. PATENT DOCUMENTS

| | | | | | |
|---|---|---|---|---|---|
| 2,806,471 | A | | 9/1957 | Breese | |
| 3,845,795 | A | | 11/1974 | Andreasson | |
| 3,921,626 | A | | 11/1975 | Neel | |
| 4,161,794 | A | | 7/1979 | Darnfors | |
| 4,617,691 | A | * | 10/1986 | Monti | A47C 7/383 128/DIG. 23 |
| 4,768,247 | A | | 9/1988 | Beier | |
| 4,979,249 | A | | 12/1990 | Meade, II | |
| 5,060,661 | A | | 10/1991 | Howard | |
| 5,217,131 | A | | 6/1993 | Andrews | |
| 5,313,678 | A | * | 5/1994 | Redewill | A47C 21/003 297/393 |
| 5,566,410 | A | * | 10/1996 | Schaechter | A47G 9/0253 5/490 |
| 5,738,557 | A | | 4/1998 | Biesecker | |
| 6,050,965 | A | | 4/2000 | Pillai | |
| 6,289,538 | B1 | | 9/2001 | Fidge | |
| D457,316 | S | | 5/2002 | Swade | |
| 7,731,314 | B2 | | 6/2010 | Kim | |
| 8,708,414 | B2 | | 4/2014 | Hurwitz | |
| 8,726,421 | B2 | | 5/2014 | Alvarez | |
| 8,728,017 | B2 | | 5/2014 | Chan et al. | |
| 8,978,693 | B2 | | 3/2015 | Frayne | |
| 9,526,361 | B2 | | 12/2016 | Sellmeyer | |
| 9,709,183 | B2 | | 7/2017 | Frayne | |
| 10,154,697 | B2 | | 12/2018 | Kasahara | |
| 2002/0162767 | A1 | * | 11/2002 | Ohtsubo | B65D 33/2591 206/524.8 |
| 2004/0063365 | A1 | | 4/2004 | Lee | |
| 2006/0130235 | A1 | * | 6/2006 | Wilson | A47G 9/0207 5/502 |
| 2006/0131339 | A1 | * | 6/2006 | Anderson | B65D 81/2038 222/212 |
| 2013/0019409 | A1 | * | 1/2013 | Blazar | A47G 9/1027 5/644 |
| 2014/0331397 | A1 | * | 11/2014 | Kasahara | A41D 13/0512 2/468 |
| 2015/0190267 | A1 | | 7/2015 | Heyman | |
| 2017/0086607 | A1 | * | 3/2017 | Wong | A47C 7/383 |
| 2020/0214465 | A1 | * | 7/2020 | Pennington | A47C 27/125 |

FOREIGN PATENT DOCUMENTS

| | | | | |
|---|---|---|---|---|
| WO | WO-2008035680 | A1 * | 3/2008 | A61F 5/055 |
| WO | WO2017061931 | | 4/2017 | |

* cited by examiner

TRAVEL PILLOW APPARATUS, STORAGE APPARATUS FOR THE TRAVEL PILLOW APPARATUS, AND METHODS OF MANUFACTURING AND USING THE SAME

PRIORITY

This application claims the benefit of priority to U.S. Provisional Patent Application Ser. No. 62/882,487 filed Aug. 3, 2019 of the same title, the contents of which being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to travel pillow apparatus along with a storage apparatus for use with, for example, the travel pillow apparatus.

DESCRIPTION OF RELATED TECHNOLOGY

The use of devices (e.g., pillows) to support a user's head and neck are well understood. For example, the earliest recorded use of so-called modern devices dates back to around 7,000 BC. The primary purpose for the use of these modern devices was to alleviate neck, back, and shoulder pain while sleeping or relaxing. More recently, these devices have been modernized for use in modern day activities such as, for example, commercial airline travel. So-called travel pillows provide support for the head and neck of its user, while the user is in a sitting or partially reclined seated position. These devices are often characterized by their "U shape" that fits around the neck and sides of the wearer that is intended to support the head from slipping into an uncomfortable position during sleep. However, often these U-shaped pillows are worn around the back of the neck, creating undue loading on the lower C-spine of the wearer, and inducing unneeded flexion and discomfort. These devices are now ubiquitous on many transportation devices throughout the world, including airplanes, trains and automobiles.

However, despite the variety and ubiquitous nature of these travel pillow designs, these travel pillows are often relatively difficult to clean, despite their common use in unhygienic conditions (e.g., airport security lines). Moreover, these travel pillow designs are typically quite bulky, making them oftentimes inconvenient to travel with, thereby decreasing their more widespread adoption. Additionally, many extant travel pillow designs do not provide optimal support for the head and neck of a user, further decreasing their more widespread adoption. Hence, there is a salient need for a travel pillow apparatus that addresses these and other deficiencies in the prior art.

SUMMARY

The present disclosure satisfies the aforementioned needs by providing for an improved travel pillow apparatus, storage apparatus for the travel pillow apparatus, as well as methods for manufacturing and using the same.

In one aspect, a travel pillow apparatus is disclosed. In one embodiment, the travel pillow apparatus includes an external covering, the external covering including an opening that enables access to an interior of the external covering, the external covering including a first circumferential dimension when ends of the external covering are secured to one another; an air bladder apparatus that includes expandable open-cell foam disposed within the interior of the air bladder apparatus, the air bladder apparatus including a second circumferential dimension when the ends of the external covering are secured to one another, the second circumferential dimension being less than the first circumferential dimension; and a valve disposed on the air bladder apparatus, the valve enabling inflation and deflation of the air bladder apparatus.

In one variant, the air bladder apparatus includes a plurality of port openings, at least a portion of the plurality of port openings including a first curved surface that joins an external surface of the air bladder apparatus with an opposing interior surface of the air bladder apparatus and a second curved surface that joins an upper portion of the air bladder apparatus with a lower portion of the air bladder apparatus.

In another variant, the expandable open-cell foam substantially conforms to a three-dimensional form of the air bladder apparatus when the air bladder apparatus is at least partially inflated.

In yet another variant, the external covering includes an aperture in which the valve disposed on the air bladder apparatus protrudes at least partly therethrough.

In yet another variant, the travel pillow apparatus further includes a pump mechanism that is configured to communicate with the valve disposed on the air bladder apparatus, the pump mechanism being configured to inflate the air bladder apparatus.

In yet another variant, a central portion of the air bladder apparatus includes a height dimension that is greater in height than end portions of the air bladder apparatus.

In yet another variant, a transition between the central portion of the air bladder apparatus and the end portions of the air bladder apparatus includes a curved transition.

In yet another variant, the curved transition acts as a clavicle relief area for a wearer of the travel pillow apparatus while the central portion of the air bladder apparatus acts as a sternal support structure for the wearer of the travel pillow apparatus.

In yet another variant, the external covering includes a plurality of mesh openings that are in operable communication with at least a portion of the plurality of port openings in the air bladder apparatus.

In yet another variant, at least a portion of the plurality of mesh openings are selectively closeable via use of material disposed on the external covering.

In yet another variant, the opening that enables access to the interior of the external covering is disposed on one end of the external covering.

In yet another variant, the travel pillow apparatus further includes a storage apparatus that includes a container having a pair of semi-rigid walls that surround a storage cavity, the storage cavity being configured to receive the external covering and the air bladder apparatus; an opening having an airtight zipper that enables selective access to the storage cavity, the opening being disposed on a largest external dimension for the container; and a one-way expulsion valve located on at least one of the pair of semi-rigid walls, the one-way expulsion valve being configured to enable compression of the storage apparatus and the air bladder apparatus for more convenient and less bulky storage of the travel pillow apparatus.

In yet another variant, the container further includes a flexible membrane disposed between the pair of semi-rigid walls, a height dimension of the pair of semi-rigid walls being taller than a height dimension for the flexible membrane so as to provide protection for the flexible membrane and the airtight zipper.

In yet another variant, the ends of the external covering are secured to one another via use of a hook and loop fastener.

In yet another variant, the opening that enables access to the interior of the external covering further includes a hook and loop fastener that enables selective access to the interior of the external covering.

In yet another variant, the opening that enables access to the interior of the external covering further includes a zipper that enables selective access to the interior of the external covering, the zipper being oriented in a fashion that is generally perpendicular with the first circumferential dimension.

In another aspect, a storage apparatus is disclosed. In one embodiment, the storage apparatus is for use with a compressible item and includes a container having a pair of semi-rigid walls that surround a storage cavity, the storage cavity being configured to receive the compressible item; an opening having an airtight zipper that enables selective access to the storage cavity, the opening being disposed on a largest external dimension for the container.

In one variant, a one-way expulsion valve is disclosed which is located on at least one of the pair of semi-rigid walls, the one-way expulsion valve being configured to enable compression of the storage apparatus and the compressible item for more convenient and less bulky storage of the compressible item.

In another variant, the container further includes a flexible membrane disposed between the pair of semi-rigid walls, a height dimension of the pair of semi-rigid walls being taller than a height dimension for the flexible membrane so as to provide protection for the flexible membrane and the airtight zipper.

In yet another variant, the one-way expulsion valve enables the compression of the storage apparatus and the compressible item without requiring a separate vacuum apparatus.

In yet another variant, the storage apparatus is configured to be compressed while the airtight zipper remains open. Once the storage apparatus is compressed, the airtight zipper is closed thereby providing for more convenient and less bulky storage of the compressible item.

In yet another variant, the compressible item includes a travel pillow apparatus that includes an external covering, the external covering having an opening that enables access to an interior of the external covering, the external covering having a first circumferential dimension when ends of the external covering are secured to one another; an air bladder apparatus that includes an expandable open-cell foam disposed within the interior of the air bladder apparatus, the air bladder apparatus having a second circumferential dimension when the ends of the external covering are secured to one another, the second circumferential dimension being less than the first circumferential dimension; and a valve disposed on the air bladder apparatus, the valve enabling inflation and deflation of the air bladder apparatus.

In yet another variant, the storage apparatus may be utilized for other compressible items including, for example, comforters, blankets, clothing, pool floats, tents, sleeping bags or other compressible items.

In yet another aspect, an air bladder apparatus for use with the aforementioned travel pillow apparatus is disclosed. In one embodiment, the air bladder apparatus includes a number of ports or openings as well as expandable open-cell foam therein. The air bladder apparatus may also include a valve that may be configured to partially auto-inflate via use of the expandable open-cell foam.

In yet another aspect, methods of manufacturing the aforementioned apparatus are disclosed.

In yet another aspect, methods of using the aforementioned apparatus are disclosed. In one embodiment, a method of using the aforementioned travel pillow apparatus is disclosed. The method includes inserting an air bladder apparatus into an external covering and opening a one-way valve located on the air bladder apparatus thereby causing the air bladder apparatus to self-inflate via the use of expandable open-cell foam apparatus located within the air bladder apparatus.

Other features and advantages of the present disclosure will immediately be recognized by persons of ordinary skill in the art with reference to the attached drawings and detailed description of exemplary implementations as given below.

BRIEF DESCRIPTION OF THE DRAWINGS

The features, objectives, and advantages of the disclosure will become more apparent from the detailed description set forth below when taken in conjunction with the drawings, wherein.

All Figures disclosed herein are © Copyright 2019-2020 D Squared Ventures.

Exemplary Travel Pillow Apparatus

Implementations of the present disclosure will now be described in detail with reference to the drawings, which are provided as illustrative examples so as to enable those skilled in the art to practice the technology. Notably, the figures and examples below are not meant to limit the scope of the present disclosure to a single implementation or implementations, but other implementations are possible by way of interchange of or combination with some or all of the described or illustrated elements. Wherever convenient, the same reference numbers will be used throughout the drawings to refer to same or like parts.

So-called travel pillows are ubiquitous and our generally designed and marketed to travelers as a means for providing comfort and support so as to enable passengers to, inter alia, sleep in a seated and generally upright/reclined position. For example, passengers on international (and domestic) flights may often find it difficult to adequately support their head and neck while seated in a generally upright/reclined position. As a result, numerous products have been marketed as a way by which a traveler can obtain restful sleep while traveling. Unfortunately, prior travel pillows suffer from one or more of the following deficiencies: (1) an inability to create and maintain a comfortable position for the head of a user while traveling seated in a reclined position; (2) an inability to adapt to a given user's preferences for different levels of head and neck support; (3) a relatively large or bulky design that consumes a significant amount of a traveler's luggage space; (4) an inability to preserve and maintain travel pillow hygiene (particularly in the midst of the current global pandemic); and (5) an inability to regulate heat exchange between a user and the surrounding environment, often times leading to an uncomfortable level of warmth and/or humidity for the user of prior travel pillows. The present disclosure addresses these and other problems associated with prior travel pillow designs.

Figure 1:
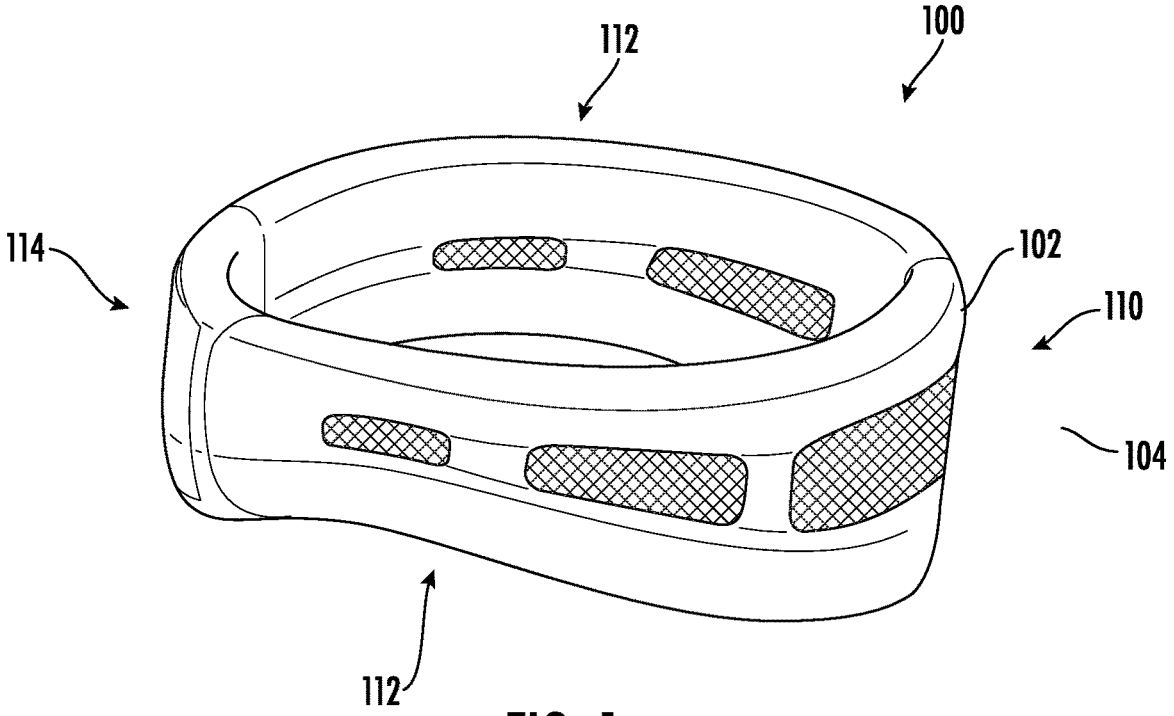
FIG. 1 is a perspective view of a travel pillow apparatus in accordance with the principles of the present disclosure.

Referring now to FIG. 1, an exemplary travel pillow apparatus 100 in shown and described in detail. The travel pillow apparatus 100 may include an external covering 102 (see also FIGS. 3A and 3B) that may be separable from the underlying air bladder apparatus (200, FIGS. 2A-2C). By enabling the selective removal of the air bladder apparatus from the external covering 102, the external covering 102 may be periodically cleaned with a minimal amount of effort. For example, the air bladder apparatus may be removed from the external covering 102, and the external covering 102 may be laundered.

The external covering 102 may also include a number of openings or ports 104 that provide for air exchange between, for example, a user's neck and the external environment. In some implementations, these openings or ports 104 may include a mesh material that is located on the external covering 102. This mesh material may be located on both the internal portion (i.e., the side of the covering 102 nearest the neck of the wearer) as well as the external portion of the external covering 102. In some implementations, the mesh material may only be located on either the external portion or internal portion of the external covering 102 (e.g., for aesthetics).

In some variants (e.g., where a single mesh material is utilized for the openings or ports 104), the external covering 102 may include one or more fastening mechanism(s) between one or more of the openings or ports 104. These one or more fastening mechanism(s) may allow the external covering 102 to more tightly conform to the geometry of the air bladder apparatus (200, FIGS. 2A-2C) while in use (e.g., when fastened), while also allowing for the removal of the air bladder apparatus from the external covering 102 when the fastening mechanism is unfastened. Exemplary fastening mechanisms may include one or more of a button (e.g., shank buttons, flat or sew-through buttons, stud buttons, snap fasteners, etc.), a hook-and-loop fastener (e.g., Velcro®), or any other type of suitable fastener device(s).

Figure 1A:
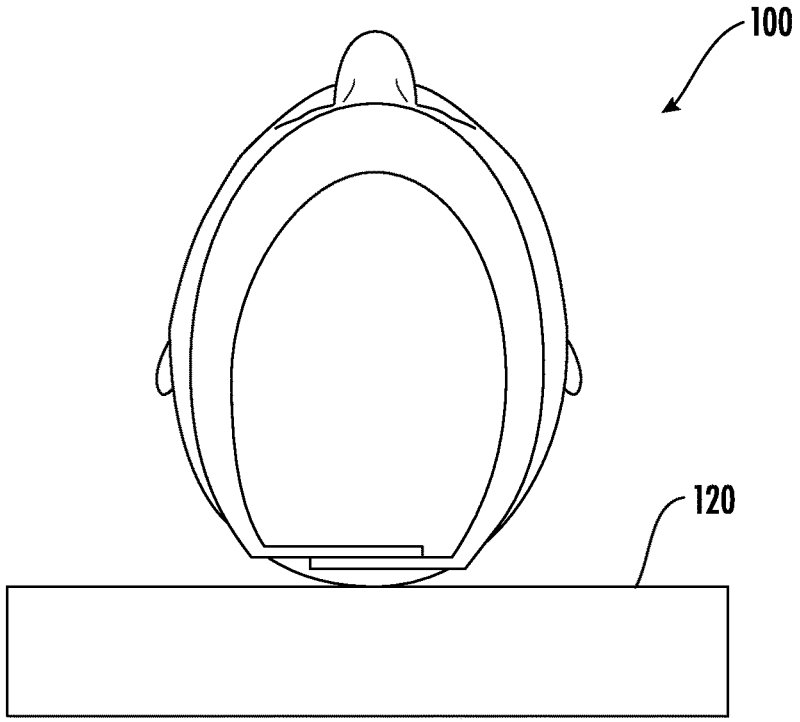
FIG. 1A is a bottom-side plan view of a user of the travel pillow apparatus in relation to a headrest in accordance with the principles of the present disclosure.

In some implementations, the air bladder apparatus (200, FIGS. 2A-2C) is only intended to be positioned within the front 110 and side portions 112 of the external covering 102. The air bladder apparatus may not be positioned within the back portion 114 of the external covering 102 (e.g., adjacent to the wearer's spinal column). Such an implementation may be desirable in many travel applications. For example, a passenger on many transportation devices (e.g., airplanes, trains, automobiles, etc.) will be typically oriented in a partially reclined, supine position (i.e., lying face upward) in their seat. These seats are typically ergonomically designed and provide support to the posterior aspect of the head for the individual sitting in the seat. Accordingly, this aspect of many typical transportation seats may not be well served by an unnecessarily bulky travel pillow apparatus located at the posterior of the head (which is a common trait of prior travel pillow designs). Accordingly, the presently described travel pillow apparatus 100 creates comfortable support for the head of its wearer via other means. FIG. 1A illustrates a bottom-side plan view of a wearer of the travel pillow apparatus' 100 head in relation to a headrest 120 on a typical transportation seat of the type commonly associated with airlines, buses, automobiles, trains and other sorts of similar transportation platforms.

Figure 2A:
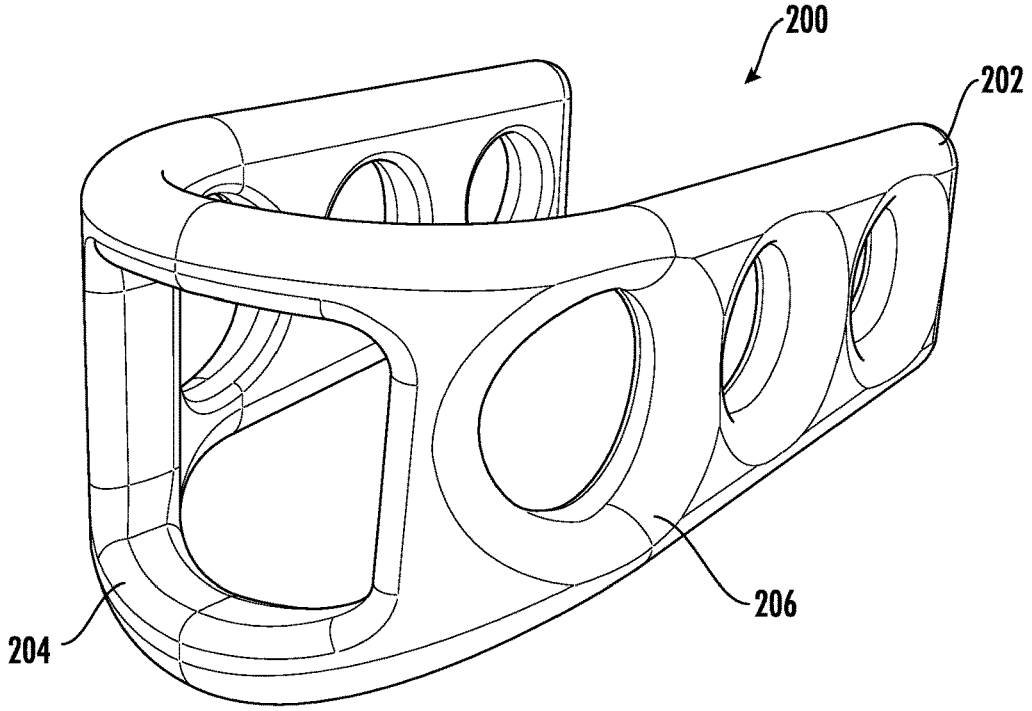
FIG. 2A is a perspective view of an air bladder apparatus for use with the travel pillow apparatus of FIG. 1 in accordance with the principles of the present disclosure.
Figure 2B:
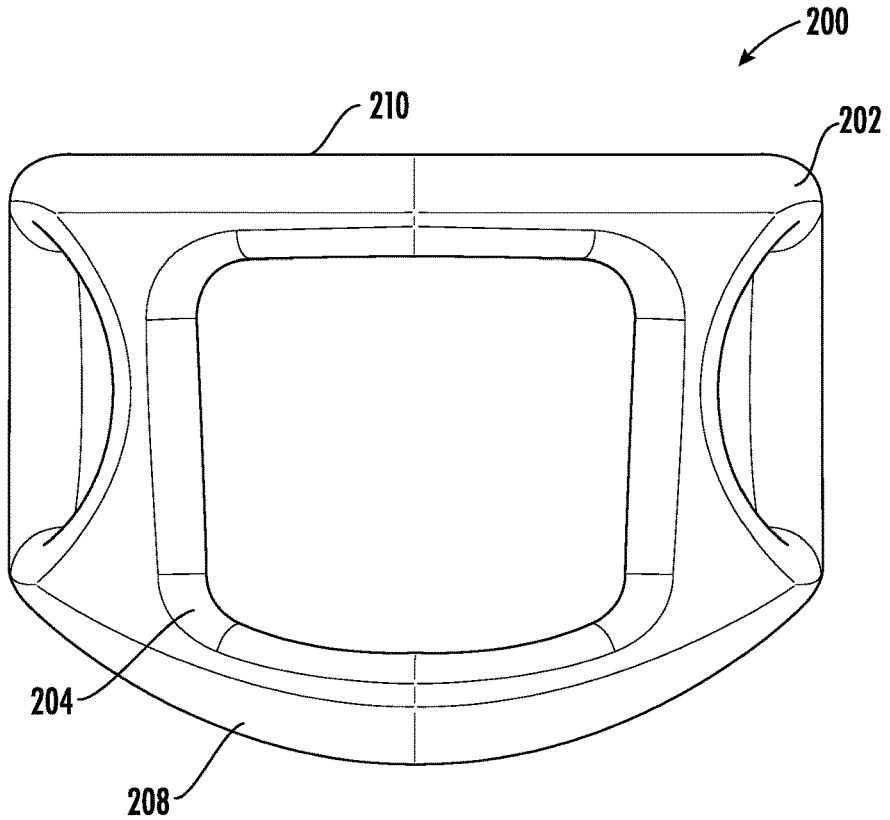
FIG. 2B is a front side elevation view of the air bladder apparatus of FIG. 2A in accordance with the principles of the present disclosure.
Figure 2C:
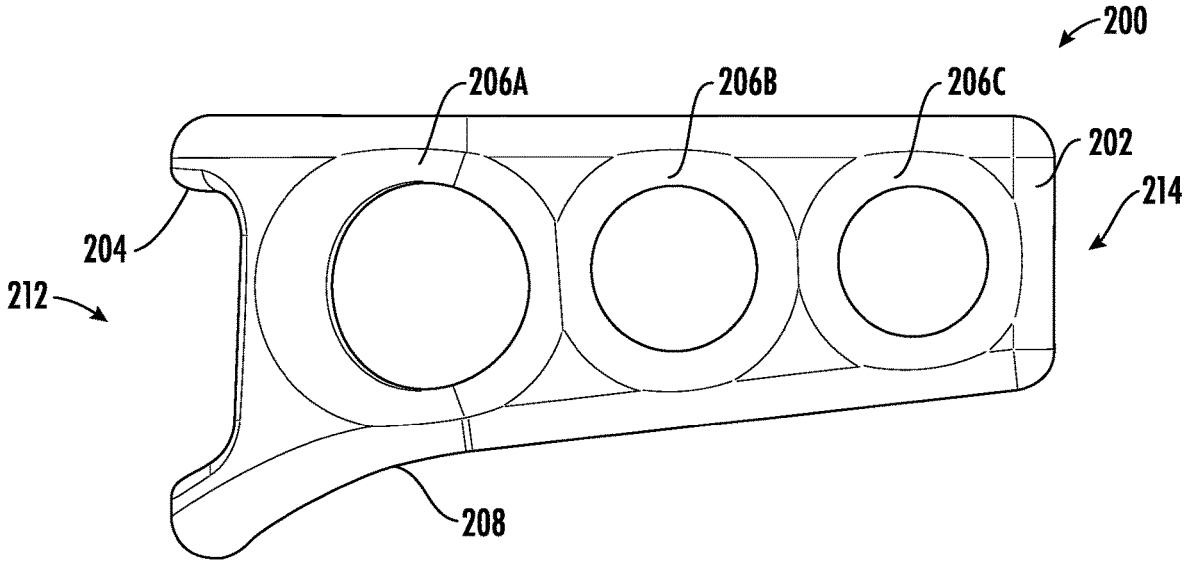
FIG. 2C is a right-side elevation view of the air bladder apparatus of FIG. 2A in accordance with the principles of the present disclosure.
Figure 3A:
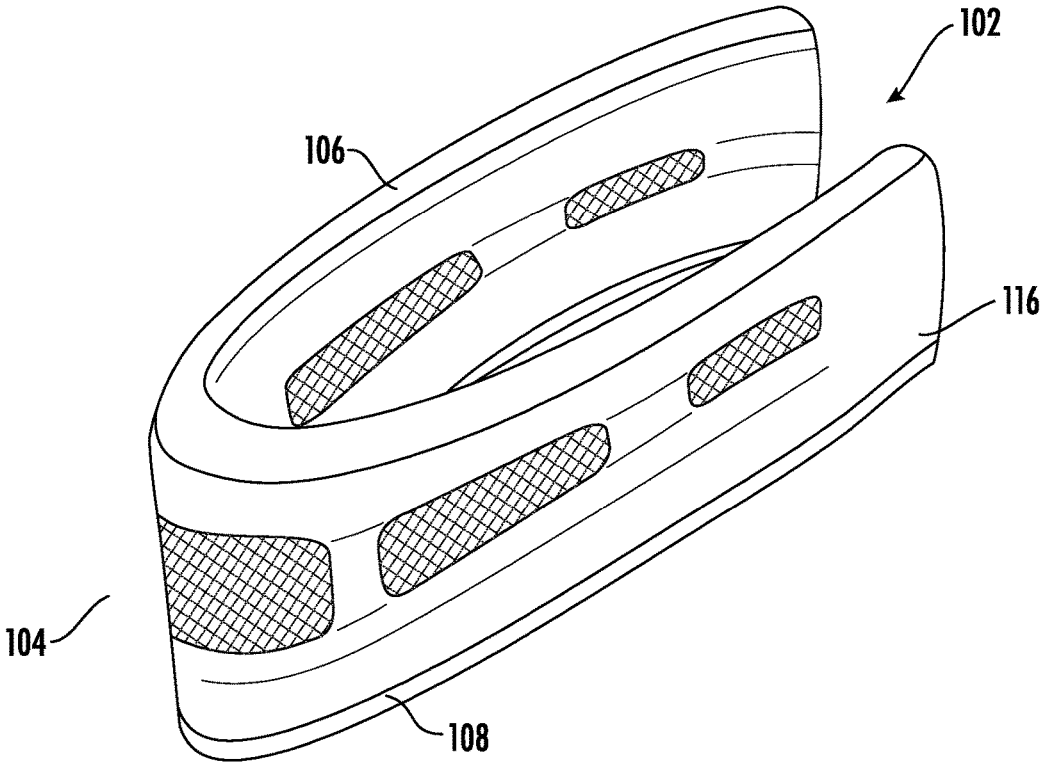
FIG. 3A is a perspective view of external covering for the travel pillow apparatus of FIG. 1 in accordance with the principles of the present disclosure.

Referring now to FIGS. 2A-2C, an exemplary air bladder apparatus 200 is shown and described in detail. The air bladder apparatus 200 creates comfortable support of the head by providing most of its support superiorly up under the mandible (i.e., lower jawbone) of its user. Stabilizing support is directed in the opposite inferior direction against the shoulder and truncal structures of the user, such as the upper trapezius, pectoralis, and sternal structures, respectively. Additionally, because the air bladder apparatus 200 is inflatable, the height and firmness of the air bladder apparatus 200 is adjustable, thereby providing support and comfort across a wide swathe of human anatomies and sizes. Referring now to FIG. 2C, a right-side view of the air bladder apparatus 200 is shown. Proper placement of the air bladder apparatus 200 requires the placement of the tall region 212 of the air bladder apparatus 200 (i.e., left side of air bladder apparatus 200 shown in FIG. 2C) under the chin of the wearer. Note also that the opposing end 214 of the air bladder apparatus 200 is not as tall as the tall region 212. The tall region 212 is intended to provide support between the chin/mandible region and the sternal region of the wearer of the travel pillow apparatus 200. The opposing ends 214 of the air bladder apparatus 200 are intended to be positioned under the right and left sides of the mandible of the wearer. The air bladder apparatus 200 is further configured to have a reduced distance between the upper portion 210 and the lower portion 208 of the air bladder apparatus 200 between the lateral aspects of the mandible and upper trapezius of the wearer as compared with the distance between the chin and sternum dimension of the wearer.

In some implementations, the lower portion 208 of the air bladder apparatus 200 includes a curved profile as shown in FIG. 2C, while the top portion 210 of the air bladder apparatus 200 includes a generally straight profile. The height of the rear portion 214 of the air bladder apparatus 200 will be approximately 65% (e.g., from about 60-70%) that of the height of the front portion 212 of the air bladder apparatus 200. Moreover, about a third of the distance from the front portion 212 of the air bladder apparatus 200 to the rear portion 214 of the air bladder apparatus 200, the height between the top portion 210 and the bottom portion 208 will be approximately 80% (e.g., from about 75-85%) that of the height of the front portion 212 of the air bladder apparatus 200. The height between the top portion 210 and the bottom portion 208 may be varied dependent upon the amount of air used to fill the inside of the air bladder apparatus 200. Herein lies one salient advantage of the travel pillow apparatus 100 of the present disclosure over prior devices, namely the ability for these narrower dimensions on the sides of the air bladder apparatus 200 to mimic the contours of the human body in order to provide continuous support under the mandible, while leaving an opening in the back so that the seat head rest can comfortably support the posterior aspect of the head. Such dimensions enable a user of the travel pillow apparatus 100 to be adequately and comfortably supported while sitting in a partially reclined, supine position. In some implementations, it may be desirable for the portion of the air bladder apparatus 200 positioned towards the back of the wearer's head to be thinner in dimension (i.e., tapered) as compared with other portions of the air bladder apparatus 200 in order to, for example, accommodate the varying geometries between a given seat.

The air bladder apparatus 200 may also include a number of openings or ports 204, 206. As shown in FIGS. 2A-2C, the illustrated air bladder apparatus 200 includes a rectangular front port 204, along with a total of six (6) side circular ports 206 (i.e., three (3) ports 206 per side), although it would be readily apparent to one of ordinary skill given the contents of the present disclosure that the precise shape and number of ports 204, 206 may be varied in other contemplated variants. For example, as shown in FIG. 2A, the three-dimensional curved surfaces of the ports 204, 206 provide enhanced structural rigidity in order to support the wearer's head. In other words, the curved surfaces between the top and bottom surfaces of the air bladder apparatus 200, as well as the curved surfaces between the inside and outside surfaces of the air bladder apparatus 200 provide for this enhanced structural rigidity for the travel pillow apparatus 100.

These openings or ports 204, 206 also enable the opportunity for air exchange between the user's body (e.g., the user's neck) and the surrounding environment. In some variants, these openings or ports 204, 206 may be selectively opened or closed (e.g., via the external covering 102) in order to regulate temperature and comfort for the user. These openings or ports 204, 206 additionally provide for a reduction in stiffness for the travel pillow apparatus 100 which, for example, improves comfort for pressure sensitive regions of the human body (e.g., over bony structures such as the clavicle or the area of the point of the chin). The arrangement depicted in FIGS. 2A-2C also creates pillars of support where the body can well tolerate the pressures such as between the chin/mandible midline and the sternum, and/or between the mandible and upper trapezius far laterally. In other words, the openings or ports 204, 206 behave similarly to an arch bridge in which the loads of the wearer's head and sternum are transferred along the walls of the openings or ports 204, 206 thereby providing for increased support for the wearer of the air bladder apparatus 200.

Figure 4:
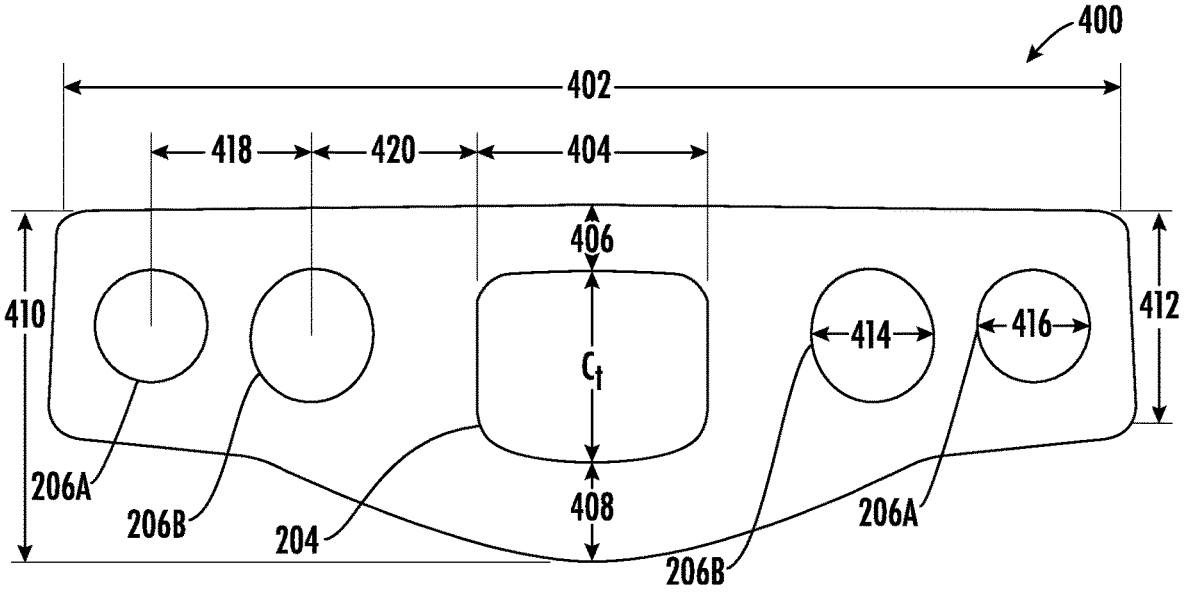
FIG. 4 is a front side elevation view of open-cell foam apparatus for use in the air bladder apparatus of FIGS. 2A-2C, in accordance with the principles of the present disclosure.

In some implementations, the air bladder apparatus 200 may include, for example, an open-cell expandable foam 400 as shown in, for example, FIG. 4 in its interior. As a brief aside, some open-cell foam materials are classified as "open", when a majority of the "cells" of the foam are open enabling the transfer of a fluidic medium such as air. The open-cell expandable foam 400 may be formed from a die-cut piece of foam (or multiple die-cut pieces of foam). In some implementations, the choice of open-cell foam chosen may have properties which enable it to operate as a spring, allowing for the open-cell foam to return to its original state after compression based in part on the material chosen as well as unrestricted fluidic medium transfer between the cells of the open-cell foam. Hence, the use of open-cell expandable foam 400 enables the air bladder apparatus 200 to partially auto-inflate when a valve located on the air bladder apparatus is opened. For example, when in its fully deflated storable state, the open-cell expandable foam may be compressed. Upon opening of the valve located on the air bladder apparatus 200 (e.g., within port opening 206*c*), the open-cell expandable foam will expand, thereby automatically drawing air inside of the air bladder apparatus 200.

In some implementations, this auto-inflation mechanism will only partially inflate the air bladder apparatus 200. Final bladder inflation pressure may be achieved and regulated by a user manually inflating the remainder of the air bladder apparatus by, for example, blowing into the incorporated valve or by inflating through the use of an attached or otherwise supplied pump. Such a scheme enables a user to regulate the internal pressure of the air bladder apparatus 200, thereby allowing a user to adjust both the height of the air bladder apparatus 200 as well as the firmness of the travel pillow apparatus as desired. The incorporated valve or the use of an attached or otherwise supplied pump may be accessed through the external covering 102 in some implementations. In some implementations, the open-cell expandable foam 400 may mimic the geometry of the air bladder apparatus 200 including the curved surfaces of the ports 204, 206 (i.e., the curves between the top and bottom of the air bladder apparatus 200 as well as the curves between the inside and outside surfaces of the air bladder apparatus 200 in order to enhance the auto-inflation abilities for the open-cell expandable foam 400.

Figure 3B:
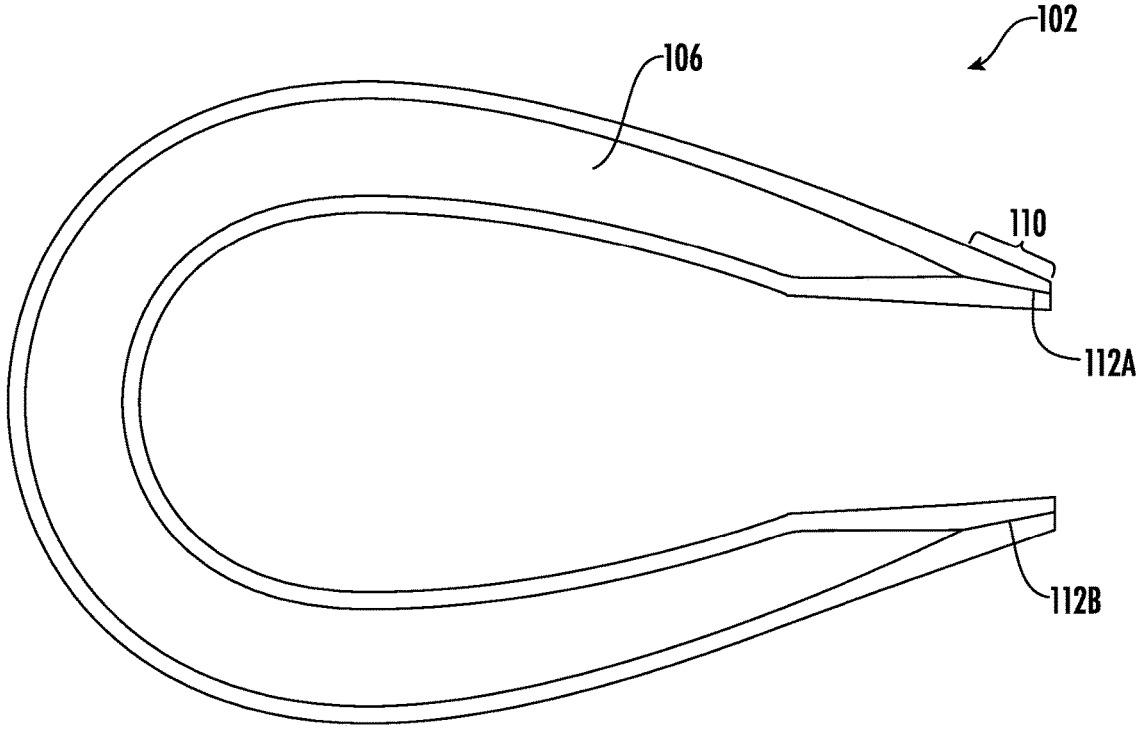
FIG. 3B is a top-side plan view of the external covering of FIG. 3A in curved form in accordance with the principles of the present disclosure.
Figure 3C:
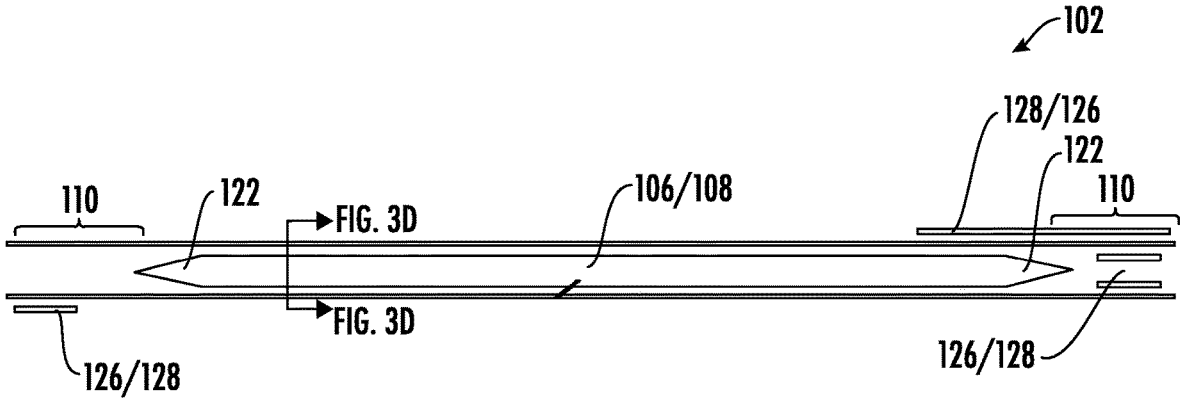
FIG. 3C is a top-side plan view of the external covering of FIG. 3A in flat form in accordance with the principles of the present disclosure.
Figure 3D:
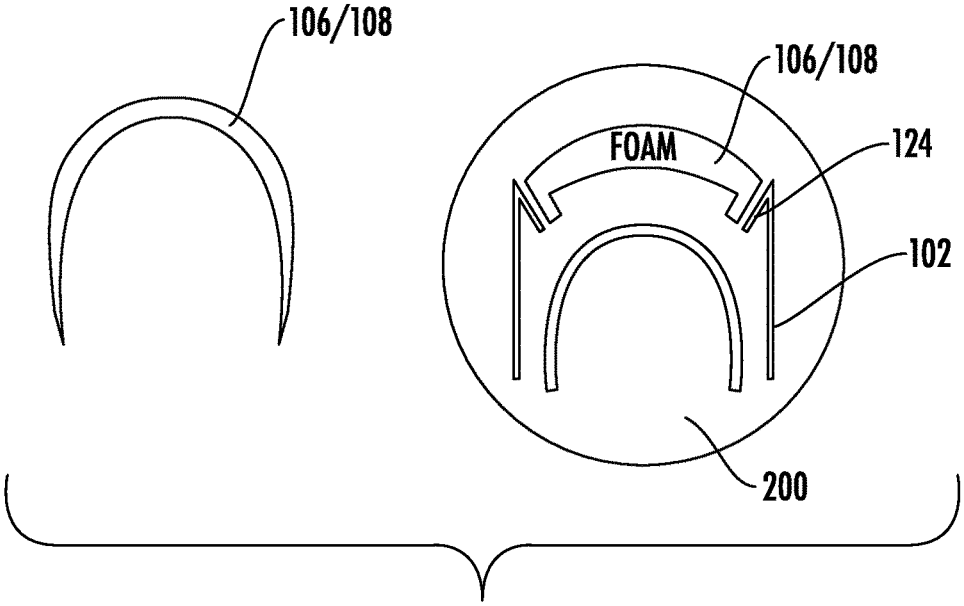
FIG. 3D is a cross-sectional view of the U-shaped interface material integrated into the external covering of FIG. 3A in accordance with the principles of the present disclosure.

Referring now to FIGS. 3A-3E, the external covering 102 for the travel pillow apparatus is shown and described in detail. The external covering 102 may be easily manufactured from a soft textile material that provides a durable, yet comfortable interface with the user's anatomy. While one primary consideration for the external covering 102 is to create an ergonomically-designed comfortable interface for the user, in some implementations, the external covering 102 may also provide for an increased amount of stiffness (in conjunction with the air bladder apparatus 200) in order to properly support the head of the user during, for example, sleep. In some implementations, this may be accomplished through use of a U-shaped interface material on the top 106 and bottom 108 portions of the external covering 102. The U-shaped ceiling component 106 and U-shaped floor component 108 may be made from a die cut foam laminate, an injection molded soft ethylene-vinyl acetate (EVA), or any other soft foam interface material that retains a resting U-shape. The U-shaped ceiling 106 and floor components 108 may be cut from a section of flat material or may even be molded into a compound three-dimensional shape with a radiused surface that both accommodates the geometry of the air bladder apparatus 200 as well as provides additional structural stiffness or rigidity. Moreover, regardless of the material chosen for the U-shaped ceiling 106 and floor components 108, it may ultimately provide a soft interface for the skin of the wearer, especially in the regions of the mandible superiority and sternum clavicles and upper trapezius contact areas. FIG. 3D illustrates one exemplary implementation of the U-shaped ceiling 106 and floor components 108, where they have been attached to the external covering 102 via use of two or more seams 124 which couple the U-shaped ceiling 106 and floor components 108 to the external covering 102.

In some implementations, the U-shaped interface 106/108 may be incorporated into the air bladder apparatus 200 instead of (or in addition to) its incorporation into the external covering 102. For example, in some implementations it may be desirable to incorporate the U-shaped ceiling 106 and floor components 108 into the air bladder apparatus 200 in order to, inter alia, facilitate the cleaning of the external covering 102. In other words, the materials utilized for the U-shaped ceiling 106 and/or floor components 108 may be sensitive to machine washing and therefore it may be desirable to enable machine washing for the external covering 102, while handwashing the air bladder apparatus 200 which may be cleaned less frequently than the external covering 102.

In some implementations, the walls 116 of the external covering are manufactured from a soft non-stretch textile material with breathable mesh openings 104. These mesh openings 104 may be selectively opened/closed in some implementations in order to regulate temperature around, for example, the user's neck. For example, a user of the travel pillow apparatus 100 may choose to open those mesh openings 104 that may be directed towards an air conditioning vent, while keeping the other mesh openings 104 closed and vice versa. In other words, the mesh openings 104 may be utilized in a fashion that enables the wearer to retain heat in areas of their neck in certain instances, while also enabling the wearer to cool other areas of their neck. Accordingly, these mesh openings 104 enable the wearer of the travel pillow apparatus 100 to selectively regulate their own temperature and comfort dependent upon the environmental conditions the wearer may be experiencing.

As shown in FIG. 3B, the dimensional length of the external covering textile wall would be greater than the length of the air bladder apparatus 200. Accordingly, the ends 110 of the external covering 102 are not designed to accommodate the air bladder apparatus 200 when properly situated within the external covering 102, thereby reducing the amount of bulk of the travel pillow apparatus 100 towards the back of the wearer's head. In order to receive the air bladder apparatus 200, one or both ends 112*a*, 112*b* of the external covering may be opened to receive the air bladder apparatus 200, in some implementations. These opening(s) 112*a*, 112*b* may facilitate the insertion/removal of the air bladder apparatus 200 thereby enabling ease of cleaning for the external covering 102. In some variants, the air bladder apparatus 200 may be received within the external covering 102 via a selectable closable opening that runs circumferentially along the surface of the external covering 102. For example, a zippered opening may be included on the exterior surface of the external covering 102, and/or this opening may include hook and loop fasteners alternatively than (or in addition to) the zippered opening.

The height dimensions for the external covering 102 may be scaled to correspond to the height dimensions for the air bladder apparatus 200. The external (and internal) walls 116 of the external covering 102 are attached (e.g., via sewing, gluing, radio frequency (RF) or ultrasonic welding, etc.) to the U-shaped ceiling 106 and floor components 108. The U-shaped ceiling 106 and floor components 108 constrain the wall's shape when the air bladder apparatus 200 is inflated, while the wall's 116 non-stretch construction constrains the air bladder apparatus 200 under tension. Accordingly, the external covering's 102 construction acts as a constraint for the air bladder apparatus 200.

In some implementations, both ends 110 of the external covering 102 may include hook and loop contact closures (e.g., Velcro®) so as to enable the travel pillow apparatus 100 to be secured around the wearer's neck. Such incorporation of hook and loop material into the external covering provides for numerous advantages including providing a thin (non-bulky) material behind the user's neck, providing added stiffness so as to provide additional structural support of the textile in order to, inter alia, prevent wrinkling of the material behind the user's neck, while also providing virtually infinite sizing (within the constraints of the length of hook and loop closure material), thereby allowing for a fine degree of granularity for the wearer in controlling the circumferential dimension about the neck. While the use of hook and loop material on the ends of the external covering are exemplary, it would be appreciated that other connection mechanism (e.g., buttons, zippers, etc.), may be substituted in place of (or in addition to), the hook and loop material in some implementations.

Figure 3E:
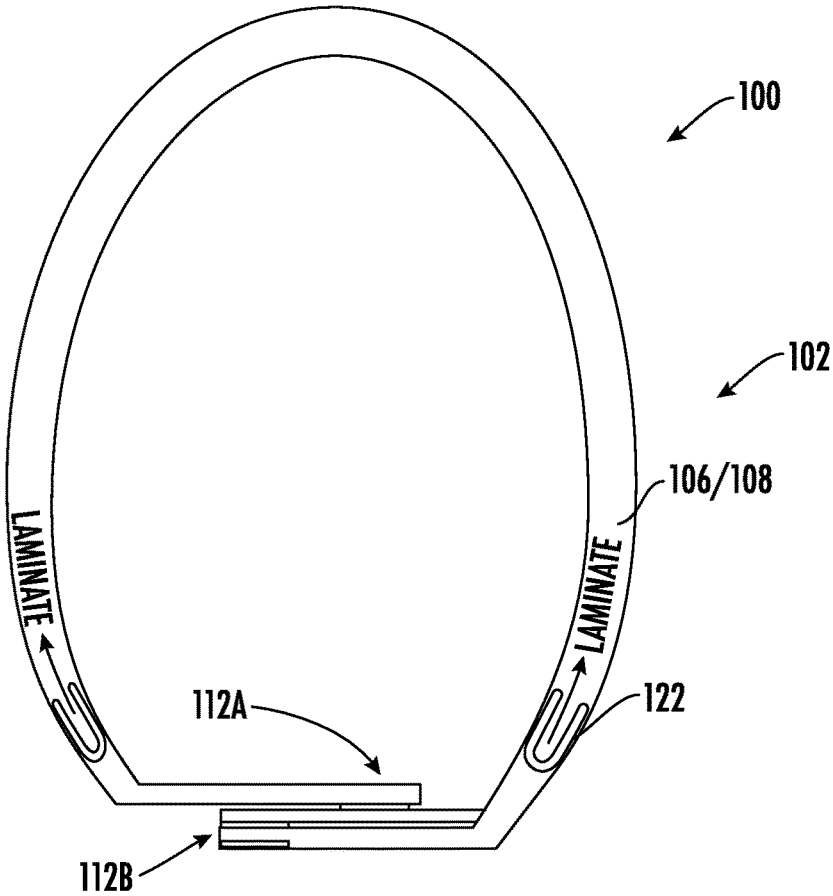
FIG. 3E is a top-side plan view of the external covering of FIG. 3A in closed form in accordance with the principles of the present disclosure.

As depicted in FIGS. 3C and 3E, the U-shaped ceiling 106 and floor components 108 may include tapered ends 122 which provides for additional comfort of the wearer of the travel pillow apparatus 100 by, inter alia, reducing the bulk towards the rear of the wearer's head when wearing the travel pillow apparatus 100. As shown in FIG. 3C, the external covering 102 may include hook 126 and loop 128 fasteners such as Velcro®. The hook 126 and loop 128 fasteners not only enable the ends 110 of the external covering 102 to be removably secured to one another, but also provide for a means of insertion/removal of the air bladder apparatus 200 from the external covering 102. In some implementations, one end 110 of the external covering 102 may be secured in a closed position (through e.g., sewing), while the other end 110 is selectively accessible via use of, for example, hook 126 and loop 128 fasteners.

Referring now to FIG. 4, one exemplary implementation of the open-cell expandable foam 400 for use in the air bladder apparatus 200 is shown. In the embodiment depicted, the open-cell expandable form 400 generally mimics the two-dimensional profile of the air bladder apparatus 200. In some implementations, the overall length 402 may be approximately seventeen (17) inches, with the overall height 410 may be approximately five and a half (5.5) inches. The height 412 at the ends of the open-cell expandable foam 400 may be approximately three and three-quarter (3.75) inches. The gap 406 between the top of the open-cell expandable foam 400 and the central port 204 may be approximately one and a quarter (1.25) inches, while the gap 408 may be approximately one and a half (1.5) inches. The port 204 may be centered around the center line of the open-cell expandable foam 400 and may have a width 404 of approximately three and three-quarter (3.75) inches. The ports 206*b* closest to the rectangular port 204 may have a diameter 414 of approximately two (2) inches and be spaced a distance 420 from the rectangular port 204 by approximately two and a half (2.5) inches. The outer ports 206*a* may have a diameter 416 of approximately one and three-quarter (1.75) inches and may be spaced from the center of the inner ports 206*b* at a distance 418 of approximately two and a half (2.5) inches. While specific dimensions are discussed above with reference to the open-cell expandable foam 400, it would be readily apparent to one of ordinary skill given the contents of the present disclosure that these dimensions may be varied to other suitable dimensions in some implementations with the foregoing merely being exemplary.

Figure 5A:
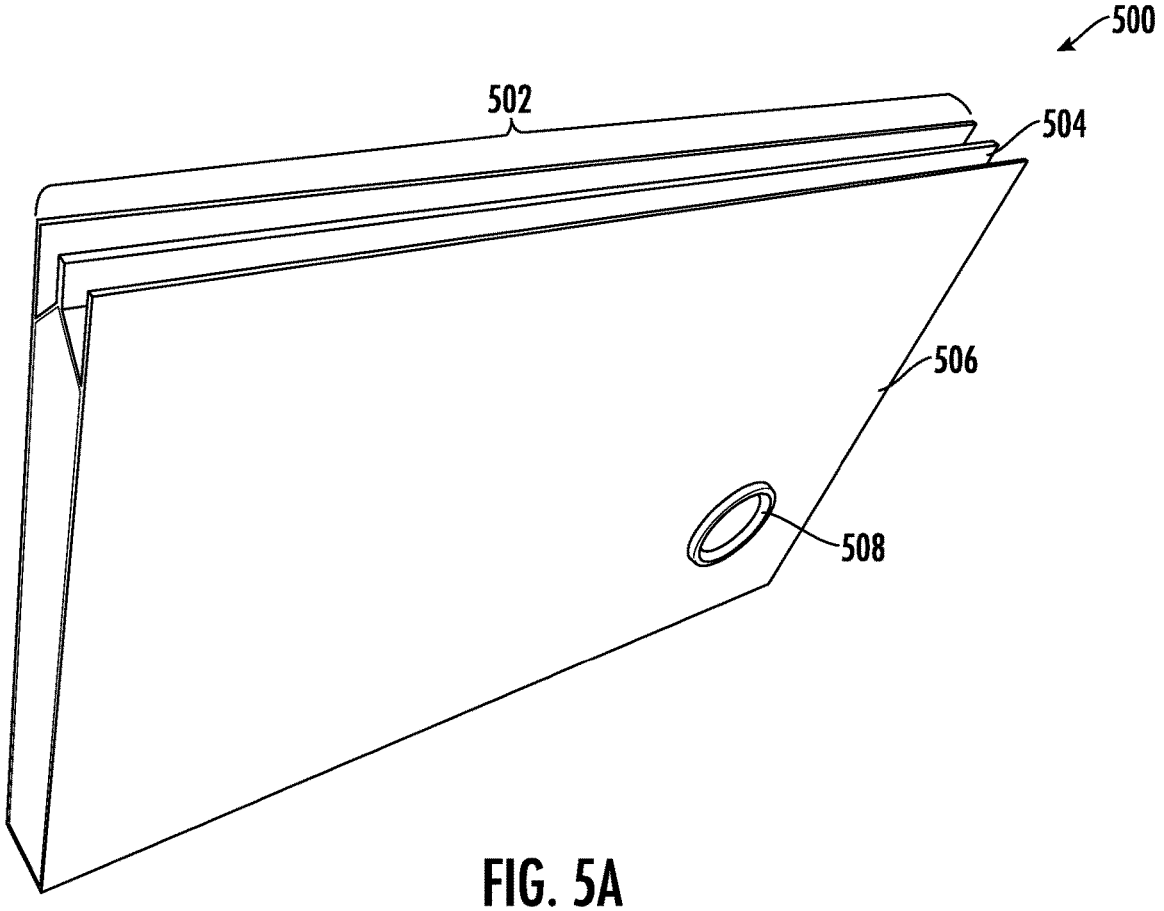
FIG. 5A is a front perspective view of an exemplary embodiment of a storage apparatus for use with, for example, the travel pillow apparatus of FIG. 1, in accordance with the principles of the present disclosure.
Figure 5B:
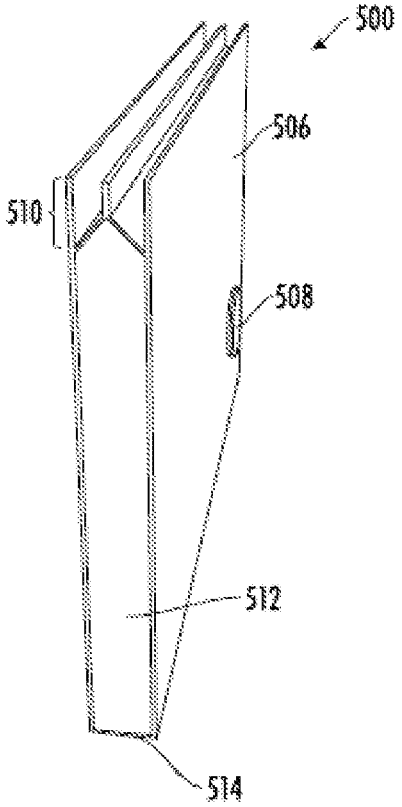
FIG. 5B is a side perspective view of the storage apparatus of FIG. 5A for use with, for example, the travel pillow apparatus of FIG. 1, in accordance with the principles of the present disclosure.

Referring now to FIGS. 5A-5B, a storage apparatus 500 for use with, for example, the aforementioned travel pillow apparatus 100 is shown and described in detail. The storage apparatus 500 includes a wide opening 502 that is securable with, for example, an airtight zipper 504. The opening 502 enables a deflated (or partially deflated) travel pillow apparatus 100 to comfortably fit inside a cavity located within the storage apparatus 500, as well as to easily be removed therefrom. The storage apparatus 500 will, in some implementations, include rigid or semi-rigid side walls 506, that sandwich a flexible membrane 512, in order to provide a defined shape for the stored travel pillow apparatus. The incorporation of the rigid or semi-rigid side walls 506, as well as a rigid or semi-rigid bottom wall 514, also provides increased protection for the travel pillow apparatus. These rigid or semi-rigid side walls 506 may include a polymer material, a metallic sheet of material and/or any other suitable type of material. Advantageously, the materials chosen for the storage apparatus 500 may be selected for its compatibility with disinfectant solutions such as, for example, hand sanitizer. As perhaps is best seen in FIG. 5B, the side walls 506 extend above the top portion of the flexible membrane 512 by a predetermined distance 510 in order to protect the flexible membrane 512 against, for example, abrasion, scuffing, etc. For example, the side walls 506 may be manufactured from a more durable material than the flexible membrane 512, and hence may provide for a suitable protection barrier for the flexible membrane 512. In some implementations, the side walls 506 also provide for a low friction exterior surface which facilitates the storage apparatus' 500 insertion into, for example, luggage or a briefcase. This may be particularly advantageous where the luggage and/or briefcase is almost completely filled with other items.

In some implementations, the storage apparatus 500 may also include an expulsion valve 508. The inclusion of an expulsion valve 508 (and side walls 506) provides a number of related benefits. For example, when the travel pillow apparatus is stored within the storage apparatus 500 with its accompanying valve left open, and with the airtight zipper 504 closed, a user may further compress the storage apparatus 500 by pressing down on one of the side walls 506 against a firm surface. This "pressing-down" expels excess air from the inside of the storage apparatus 500 (and air bladder apparatus 200), via the one-way expulsion valve 508, thereby further reducing the size of the storage apparatus 500 and the enclosed travel pillow apparatus 100. The incorporation of a mechanism to reduce the overall size of the storage apparatus 500 increases the perceived desirability for the travel pillow apparatus by decreasing the size and bulkiness of storage apparatus 500 during travel. Moreover, when utilized in, for example, commercial aircraft, the storage apparatus 500/travel pillow apparatus 100 assembly can be further reduced in size. For example, at altitude, cabin pressure is regulated and maintained at human-tolerable levels for the comfort of its passengers. Typically, the regulated cabin pressure is maintained at an equivalent air pressure at 8,000 feet despite the aircraft typically traveling at significantly higher altitudes (e.g., 30,000 feet). Accordingly, if the travel pillow apparatus 100 is stored in the storage apparatus 500 and compressed while at altitude, as the aircraft descends to the surface, the resulting pressure differential will further compress (and decrease) the size of the storage apparatus 500 further via use of the one-way expulsion valve 508, resulting in an even further reduced bulk for the assembly.

In some implementations, the expulsion valve 508 may not be included with the storage apparatus 500. In such implementations, the travel pillow apparatus 100 may be inserted within the cavity of the storage apparatus 500 and the airtight zipper 504 may be left open while the user of the storage apparatus 500 presses down on one of the rigid or semi-rigid sidewalls 506 against a firm surface. This "pressing down" expels excess air from the inside of the storage apparatus 500 (and air bladder apparatus 200) and the user can seal the airtight zipper 504 while the storage apparatus 500 is compressed, thereby reducing the overall size of the combined storage apparatus 500 and travel pillow apparatus 100.

The use of the storage apparatus 500 not only provides for a convenient method of storage, but also provides for a hygienic method of storage for the travel pillow apparatus 100 when the two items (storage apparatus 500 and travel pillow apparatus 100) are optionally used in combination. For example, airports are considered one of the most germ-laden environments that people will commonly encounter, particularly when it comes to use of the security bins and conveyor belts that are common fixtures of airport security lines. Additionally, during the current global pandemic, germs, and viruses (e.g., COVID-19) are at the forefront of traveler's minds. The storage apparatus 500 provides for hygienic storage of the travel pillow apparatus 100 between uses, thereby facilitating its widespread adoption and use as compared with prior travel pillow designs that do not include a means for hygienic storage. The combination of a hygienic method for storage, and reduced bulkiness, makes the combination of the storage apparatus 500 and the travel pillow apparatus 100 a desirable set of products for many consumers. In other words, the combination of the storage apparatus 500 and travel pillow apparatus 100 may make the two products more desirable than if each of the storage apparatus 500 and travel pillow apparatus 100 were sold or otherwise available individually (i.e., without the other).

In some implementations, the storage apparatus 500 may be utilized without the use of the travel pillow apparatus 100. For example, the storage apparatus 500 may be utilized to conveniently store other large bulky items such as, without limitation, comforters, blankets, clothing, pool floats, tents, sleeping bags or other compressible items. In such variants, the overall dimensions of the storage apparatus 500 may be adjusted in accordance with its intended purpose and/or may be adjusted in accordance with environment in which the storage apparatus 500 is to be stored (e.g., standard cabinet sizes, standard closet sizes, etc.). In such variants, the storage apparatus 500 may also include an expulsion valve 508 in such variants. The inclusion of this expulsion valve 508 (and rigid or semi-rigid side walls 506) provides similar benefits to those as previously discussed supra. For example, when the compressible items are stored within the storage apparatus 500, with the airtight zipper 504 closed, a user may compress the storage apparatus 500 by pressing down on one ofthe side walls 506 against a firm surface, thereby expelling excess air from the inside of the storage apparatus 500, via the one-way expulsion valve 508, thereby further reducing the size of the storage apparatus 500 along with the stored compressible items. Conveniently, such a storage apparatus 500 does not require the use of other items such as vacuums and the like in order to achieve its functionality, thereby facilitating its adoption through its convenience.

Figure 6:
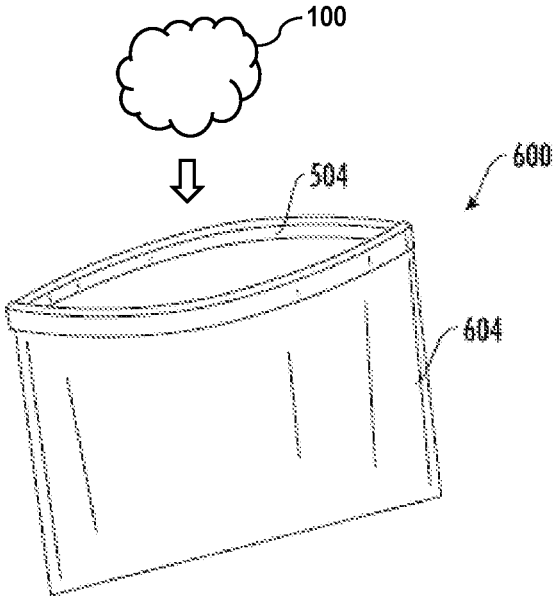
FIG. 6 is a front perspective view of another exemplary embodiment of a storage apparatus for use with, for example, the travel pillow apparatus of FIG. 1, in accordance with the principles of the present disclosure.

FIG. 6 illustrates a folio-style storage apparatus 600 which includes a pair of side walls 604 as well as an opening that is selectively sealable via inclusion of an airtight zipper 504. In some implementations, the folio-style storage apparatus 600 does not include an expulsion valve so that the compressible item received within the cavity is first compressed with the airtight zipper 504 open, followed by the airtight zipper 504 being closed during compression thereby reducing the size and overall volume of the storage apparatus 600. In some implementations, the storage apparatus 600 may include an expulsion valve as described elsewhere herein which enables the storage apparatus 600 to be compressed with the airtight zipper 504 being closed.

Figure 7:
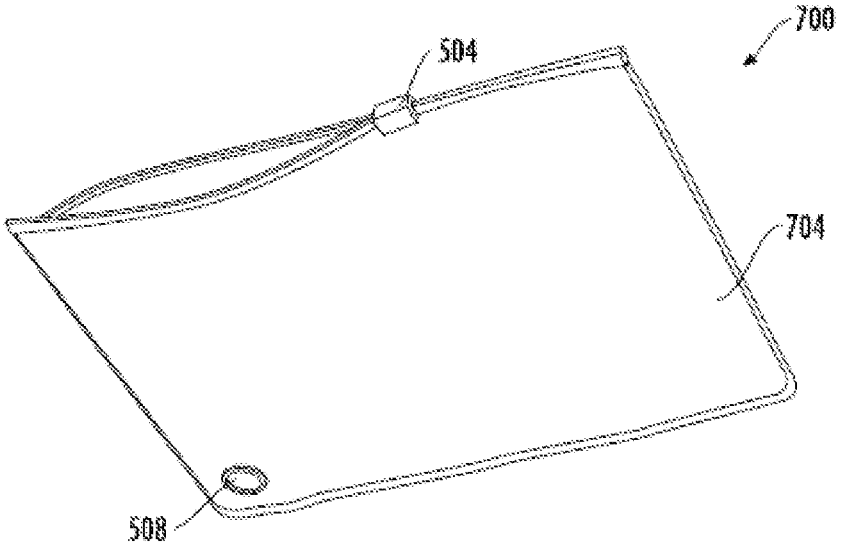
FIG. 7 is a front perspective view of yet another exemplary embodiment of a storage apparatus for use with, for example, the travel pillow apparatus of FIG. 1, in accordance with the principles of the present disclosure.

FIG. 7 illustrates a compressible pouch storage apparatus 700. The compressible pouch storage apparatus 700 may include an airtight zipper 504 as well as relatively rigid or semi-rigid sidewalls 704 in some implementations. One or both of these rigid or semi-rigid sidewalls 704 may include an expulsion valve 508 that may be used for compression of the storage apparatus 700 while the airtight zipper 504 is closed thereby reducing the size and overall volume of the storage apparatus 700. In some implementations, the compressible pouch storage apparatus 700 may be constructed without an accompanying expulsion valve 508 which still allows for compression; however, the airtight zipper 504 must remain in the open position during compression. Each of the storage apparatus 500, 600, 700 depicted in FIGS. 5-7, respectively, may be used in combination with, for example, the travel pillow apparatus 100 in order to minimize size during transportation while providing for hygienic storage of, for example, the travel pillow apparatus 100.

It will be recognized that while certain aspects of the present disclosure are described in terms of specific design examples, these descriptions are only illustrative of the broader methods of the disclosure and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. A travel pillow system, comprising:

an external covering, the external covering comprising an opening that enables access to an interior of the external covering, the external covering comprising a first circumferential dimension when ends of the external covering are secured to one another, the external covering comprising a front portion, side portions and a rear portion, the rear portion comprising the ends of the external covering;

an air bladder apparatus comprising a second circumferential dimension when the ends of the external covering are secured to one another and the air bladder apparatus is disposed inside of the external covering, the second circumferential dimension being less than the first circumferential dimension, the air bladder apparatus being received within the front portion and the side portions of the external covering, the second circumferential dimension enabling the air bladder apparatus to not be positioned within the rear portion of the external covering, the air bladder apparatus further comprising a plurality of port openings with a first port opening of the plurality of port openings comprising a different geometrical shape than other ones of the plurality of port openings, the first port opening comprising the different geometrical shape providing for a reduction in stiffness in an area of the air bladder apparatus when the air bladder apparatus is inflated as compared with the other ones of the plurality of port openings, the area of the air bladder apparatus with the reduction in stiffness comprising a central portion of the air bladder apparatus that is disposed halfway between opposing ends of the air bladder apparatus, the first port opening comprising a rectangular shaped front port with a height dimension for the rectangular shaped front port being at least half of the height for the central portion of the air bladder apparatus and the other ones of the plurality of port openings comprising round holes of varying diameters; and a valve disposed on the air bladder apparatus, the valve enabling inflation and deflation of the air bladder apparatus.

2. The travel pillow system of claim 1, wherein at least a portion of the plurality of port openings comprising a first curved surface that joins an external surface of the air bladder apparatus with an opposing interior surface of the air bladder apparatus and a second curved surface that joins an upper portion of the air bladder apparatus with a lower portion of the air bladder apparatus.

3. The travel pillow system of claim 2, further comprising an expandable open-cell foam disposed within the air bladder apparatus, the expandable open-cell foam substantially conforms to a three-dimensional form of the air bladder apparatus when the air bladder apparatus is at least partially inflated.

4. The travel pillow system of claim 3, wherein the external covering includes an aperture in which the valve disposed on the air bladder apparatus protrudes at least partly therethrough.

5. The travel pillow system of claim 2, wherein the central portion of the air bladder apparatus comprises a height dimension that is greater in height than the opposing ends of the air bladder apparatus.

6. The travel pillow system of claim 5, wherein a transition between the central portion of the air bladder apparatus and the opposing ends of the air bladder apparatus comprises a curved transition.

7. The travel pillow system of claim 6, wherein the curved transition acts as a clavicle relief area for a wearer of the travel pillow apparatus.

8. The travel pillow system of claim 7, wherein the external covering comprises a plurality of mesh openings that are in operable communication with at least a portion of the plurality of port openings in the air bladder apparatus.

9. The travel pillow system of claim 8, wherein at least a portion of the plurality of mesh openings are selectively closeable.

10. The travel pillow system of claim 7, wherein the opening that enables access to the interior of the external covering is disposed on one end of the external covering.

11. The travel pillow system of claim 1, further comprising a storage apparatus, the storage apparatus comprising:

a container comprising a pair of semi-rigid walls that surround a storage cavity, the storage cavity being configured to receive the external covering and the air bladder apparatus;

an opening comprising an airtight zipper that enables selective access to the storage cavity, the opening being disposed on a largest external dimension for the container; and a one-way expulsion valve located on at least one of the pair of semi-rigid walls, the one-way expulsion valve being configured to enable compression of the storage apparatus and the air bladder apparatus for more convenient and less bulky storage of the travel pillow apparatus.

12. The travel pillow system of claim 11, wherein the container further comprises a flexible membrane disposed between the pair of semi-rigid walls, a height dimension of the pair of semi-rigid walls being taller than a height dimension for the flexible membrane so as to provide protection for the flexible membrane and the airtight zipper.

13. The travel pillow system of claim 2, wherein the ends of the external covering are secured to one another via use of a hook and loop fastener.

14. The travel pillow system of claim 13, wherein the opening that enables access to the interior of the external covering further comprises a hook and loop fastener that enables selective access to the interior of the external covering.

15. The travel pillow system of claim 1, wherein the air bladder apparatus comprises a continuous curved profile on a bottom portion of the air bladder apparatus and further comprises a continuous straight profile on a top portion of the air bladder apparatus; and the air bladder apparatus comprises an expandable open-cell foam that is disposed within an interior of the air bladder apparatus.

16. The travel pillow system of claim 15, wherein a height for the opposing ends of the air bladder apparatus ranges from between about sixty percent (60%) to seventy percent (70%) of a height for the central portion of the air bladder apparatus.

17. The travel pillow system of claim 16, wherein a thickness of the opposing ends of the air bladder apparatus is less than a thickness of the central portion of the air bladder apparatus.

18. The travel pillow system of claim 1, wherein the external covering further comprises a U-shaped ceiling component disposed on a top portion of the external covering and a U-shaped floor component disposed on a bottom portion of the external covering.

* * * * *